US012181217B2

(12) United States Patent
Patrice et al.

(10) Patent No.: US 12,181,217 B2
(45) Date of Patent: Dec. 31, 2024

(54) APPARATUS AND METHOD FOR SEPARATION OF AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Cavagne Patrice, Le Perreux (FR); Benedicte Dos Santos, Annet sur Marne (FR); Yann-Pierrick Lemaire, Antony (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 497 days.

(21) Appl. No.: 16/054,350

(22) Filed: Aug. 3, 2018

(65) Prior Publication Data

US 2019/0049177 A1 Feb. 14, 2019

(30) Foreign Application Priority Data

Aug. 3, 2017 (FR) ..... 1757493
Aug. 3, 2017 (FR) ..... 1757495
(Continued)

(51) Int. Cl.
*F25J 3/04* (2006.01)
*F25J 3/02* (2006.01)

(52) U.S. Cl.
CPC ..... *F25J 3/04818* (2013.01); *F25J 3/0295* (2013.01); *F25J 3/04012* (2013.01);
(Continued)

(58) Field of Classification Search
CPC .. F25J 3/04812; F25J 3/04818; F25J 3/04763; F25J 3/04054; F25J 3/0295;
(Continued)

(56) References Cited

U.S. PATENT DOCUMENTS 2,113,680 A 4/1938 De Baufre
2,664,718 A 1/1954 Rice
(Continued)

FOREIGN PATENT DOCUMENTS

CN 201 173 660 12/2008
DE 102 09 421 4/2003
(Continued)

OTHER PUBLICATIONS

French Search Report and Written Opinion for FR 1 757 497, mailed Mar. 19, 2018.
(Continued)

*Primary Examiner* — John F Pettitt, III
(74) *Attorney, Agent, or Firm* — Justin K. Murray

(57) ABSTRACT

An apparatus for separation of air by cryogenic distillation comprising: a system of columns; a first turbine; a warm compressor coupled to the first turbine; a second turbine; a cold compressor coupled to the second turbine; a heat exchanger; means for sending air cooled in the heat exchanger at an intermediate temperature of the heat exchanger to the cold compressor; means for sending expanded air from the second turbine to the system of columns; means for sending air compressed in the cold compressor to an intermediate point of the heat exchanger and then at least in part to the system of columns via a first valve; means for sending air compressed in the cold compressor to the inlet of the first turbine via a second valve without passing through the heat exchanger, wherein the means for sending air compressed in the cold compressor to the inlet of the first turbine via the second valve without passing through the heat exchanger is also connected to the inlet of the first turbine; means for sending a fraction of air cooled in the heat exchanger to an intermediate temperature of the latter to the first turbine; means for sending expanded
(Continued)

air from the first turbine to the system of columns; and a bypass line provided with an expansion valve configured to send air from the cold compressor to the system of columns without passing through the heat exchanger.

7 Claims, 2 Drawing Sheets

(30) Foreign Application Priority Data

Aug. 3, 2017 (FR) ..... 1757497
Aug. 3, 2017 (FR) ..... 1757498

(52) U.S. Cl.
CPC ..... *F25J 3/04024* (2013.01); *F25J 3/04054* (2013.01); *F25J 3/0406* (2013.01); *F25J 3/04066* (2013.01); *F25J 3/04109* (2013.01); *F25J 3/04127* (2013.01); *F25J 3/04187* (2013.01); *F25J 3/04193* (2013.01); *F25J 3/0423* (2013.01); *F25J 3/04254* (2013.01); *F25J 3/04296* (2013.01); *F25J 3/04381* (2013.01); *F25J 3/04393* (2013.01); *F25J 3/04406* (2013.01); *F25J 3/04412* (2013.01); *F25J 3/04775* (2013.01); *F25J 3/04781* (2013.01); *F25J 3/04787* (2013.01); *F25J 3/04812* (2013.01); *F25J 3/04824* (2013.01); *F25J 3/0486* (2013.01); *F25J 3/04866* (2013.01); *F25J 3/04896* (2013.01); *F25J 2200/04* (2013.01); *F25J 2215/42* (2013.01); *F25J 2215/50* (2013.01); *F25J 2230/08* (2013.01); *F25J 2230/22* (2013.01); *F25J 2230/40* (2013.01); *F25J 2240/04* (2013.01); *F25J 2240/10* (2013.01); *F25J 2240/42* (2013.01); *F25J 2245/40* (2013.01); *F25J 2280/10* (2013.01); *F25J 2280/20* (2013.01); *F25J 2290/12* (2013.01)

(58) Field of Classification Search
CPC .. F25J 3/04781; F25J 3/04109; F25J 2280/10; F25J 2230/08
See application file for complete search history.

(56) References Cited

U.S. PATENT DOCUMENTS

| | | | | |
|---|---|---|---|---|
| 5,440,885 | A * | 8/1995 | Arriulou | F25J 3/04296 62/646 |
| 2004/0050095 | A1 | 3/2004 | Brigham et al. | |
| 2004/0221612 | A1* | 11/2004 | Jaouani | F25J 3/04054 62/656 |
| 2006/0162379 | A1* | 7/2006 | Wilhelm | F25J 3/0489 62/641 |
| 2008/0223076 | A1 | 9/2008 | Le Bot | |
| 2010/0139208 | A1* | 6/2010 | Peltier | E04H 5/10 52/745.13 |
| 2012/0118006 | A1 | 5/2012 | Judas et al. | |

FOREIGN PATENT DOCUMENTS

| | | |
|---|---|---|
| DE | 10 2006 027650 | 2/2007 |
| DE | 10 2011 121314 | 6/2013 |
| DE | 10 2013 002094 | 8/2014 |
| EP | 0 611 936 | 8/1994 |
| EP | 0 644 388 | 3/1995 |
| EP | 1 014 020 | 6/2000 |
| EP | 1 055 894 | 11/2000 |
| EP | 1 711 765 | 4/2005 |
| EP | 1 782 011 | 1/2006 |
| EP | 2 458 311 | 5/2012 |
| EP | 2 482 016 | 8/2012 |
| EP | 2 489 968 | 8/2012 |
| EP | 2 600 090 | 6/2013 |
| EP | 2 831 525 | 10/2013 |
| EP | 2 963 369 | 1/2016 |
| EP | 2 963 370 | 1/2016 |
| FR | 2 721 383 | 12/1995 |
| FR | 2 851 330 | 8/2004 |
| FR | 2 861 841 | 5/2005 |
| FR | 2 895 068 | 6/2007 |
| FR | 2 913 759 | 9/2008 |
| FR | 2 943 408 | 9/2010 |
| FR | 2 985 305 | 7/2013 |
| FR | 3 010 778 | 3/2015 |
| FR | 3 033 397 | 9/2016 |
| GB | 1 500 610 | 2/1978 |
| JP | S54 162 678 | 12/1979 |
| JP | 2005 221 199 | 8/2005 |
| JP | 2015 114 083 | 6/2015 |
| WO | WO 2005/064252 | 7/2005 |
| WO | WO 2006/005745 | 1/2006 |
| WO | WO 2013/148799 | 10/2013 |
| WO | WO 2015/082860 | 6/2015 |

OTHER PUBLICATIONS

French Search Report and Written Opinion for FR 1 757 493, mailed Mar. 19, 2018.
French Search Report and Written Opinion for FR 1 757 495, mailed Mar. 20, 2018.
French Search Report and Written Opinion for FR 1 757 498, mailed Mar. 1, 2018.
Macconnell, "Process Control and Optimization," Separation Controls, Air Instrument Engineers Handbook, vol. II, Chapter 8.37, Jan. 1, 2006, pp. 2123-2136.
EP Search Report and Written Opinion for EP 18186654, mailed Dec. 10, 2018.

* cited by examiner

APPARATUS AND METHOD FOR SEPARATION OF AIR BY CRYOGENIC DISTILLATION

CROSS REFERENCE TO RELATED APPLICATIONS

This application claims the benefit of priority under 35 U.S.C. § 119 (a) and (b) to French patent application No. FR1757493, filed Aug. 3, 2017, French patent application No. FR1757495, filed Aug. 3, 2017, French patent application No. FR1757497, filed Aug. 3, 2017, and French patent application No. FR1757498, filed Aug. 3, 2017, the entire contents of which are incorporated herein by reference.

FIELD OF THE INVENTION

The invention relates to apparatus for separation of air by cryogenic distillation, in particular to apparatus that uses a heat exchanger to cool all the air intended for distillation. More specifically, the apparatus is cooled at least partly by two turbines, each coupled to a compressor. One of the compressors (e.g., warm compressor) has an inlet temperature higher than 0° C. and the other (e.g., cold compressor) has an inlet temperature that is an intermediate temperature of the heat exchanger, lower than 0° C., or even lower than −50° C.

BACKGROUND

The use of a compressor of this kind, known as a "cold compressor", because it has a very low inlet temperature, causes problems. At the moment of starting up the heated air in the cold compressor may be at a temperature higher than those that the heat exchanger can withstand.

It is known from FR-A-2851330 to connect the outlet of a cold compressor to the inlet of a turbine via parallel lines, one passing through the main heat exchanger of the air separation apparatus and the other not passing through it. Accordingly, on starting up the machines, it is recommended that air compressed in the cold compressor be sent to the turbine without passing through the heat exchanger, in order to avoid sending thereto air that is too hot.

This can lead to sending large quantities of hot air to the inlet of the turbine.

SUMMARY OF THE INVENTION

Certain embodiments of the present invention propose to alleviate this problem for a method that uses two turbines, by installing a common bypass line connected to the inlets of the two turbines and to the outlets of the two turbines, the line being equipped with an expansion valve. In this way it is possible to start the process more rapidly by sending some of the air from the cold compressor to the column, without passing either through the heat exchanger or through the turbines.

According to one object of the invention, there is provided apparatus for separation of air by cryogenic distillation comprising a system of columns, a first turbine, a first compressor coupled to the first turbine, a heat exchanger, means for sending air cooled in the heat exchanger to an intermediate temperature of the latter to the first compressor, means for sending expanded air from the first turbine to the system of columns, means for sending air compressed in the first compressor to an intermediate point of the heat exchanger and then at least in part to the system of columns via a valve, means for sending air compressed in the first compressor to the inlet of the first turbine via a valve without passing through the heat exchanger, a second turbine, a second compressor coupled to the second turbine, means for sending a fraction of air cooled in the heat exchanger to an intermediate temperature of the latter to the second turbine, means for sending expanded air from the second turbine to the system of columns, the means (13) for sending air compressed in the first compressor to the inlet of the first turbine via a valve without passing through the heat exchanger being also connected to the inlet of the second turbine, wherein it comprises means for sending air from the first compressor to the system of columns without passing either through the heat exchanger or through the first or second turbine, these means being constituted by a bypass line provided with a valve that is an expansion valve.

According to other optional objects:

the bypass line is connected to the outlet of the first compressor and i) to the inlet of the first turbine and to the outlet of the first turbine or ii) to the inlet of the second turbine and to the outlet of the second turbine or iii) to the outlet of the first and second turbines.

According to another object of the invention, there is provided a method of starting apparatus for separation of air by cryogenic distillation comprising a first compressor, a first turbine coupled to the first compressor, a second compressor and a second turbine, the second turbine being coupled to the second compressor, in which:

a. in normal operation, air is sent to a heat exchanger, it is cooled, at least some of the air is drawn off at an intermediate temperature of the heat exchanger, it is compressed in a first compressor, the compressed air is sent back to the heat exchanger, at least some of the compressed air, where applicable compressed in the first compressor, and cooled in the heat exchanger, is sent to a first turbine and air expanded in the turbine is sent to the system of columns, air is sent to the second compressor and it is cooled in the heat exchanger before sending it to the system of columns, where applicable after expansion in the first or second turbine, and b. during starting air is sent from the first compressor to the system of columns after expansion in a first valve, without passing either through the heat exchanger or through the first or second turbine via a bypass line provided with the valve.

According to other optional aspects:

in apparatus comprising a second compressor and a second turbine, the second turbine being coupled to the second compressor:

a. in normal operation air is sent from the second compressor and it is cooled in the heat exchanger before sending it to the system of columns, where appropriate after expansion in the first or second turbine, b. during starting air is sent from the first compressor to the inlet of the second turbine without passing through the heat exchanger.

the first turbine and the second turbine are started simultaneously.

in normal operation at least some of the air from the first compressor is sent to the heat exchanger and then to the system of columns via a first valve and during at least a portion of the starting the first valve is closed.

in normal operation at least some of the compressed air cooled in the heat exchanger is sent to a first turbine via a first line and during starting air intended for the system of columns is caused to circulate without passing through the exchanger or the first or second turbine and passing through the first line in the opposite direction to that in normal operation.

during starting air intended for the system of columns is caused to circulate in a bypass line provided with the first valve and during normal operation air is not caused to circulate in the bypass line.

during starting, according to one approach, air is not sent to the first turbine and/or during starting air is not sent to the second turbine.

during starting all the air is sent to the system of columns by passing it through the bypass line.

during starting, according to one approach, air is sent to expand in the first turbine without being cooled in the heat exchanger.

The starting method can therefore use lines used in normal operation but causing air to circulate in the opposite direction compared to normal operation. This makes it possible in particular to reduce the length of the dedicated circuits for starting and therefore their cost.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION OF THE INVENTION

Figure 1:
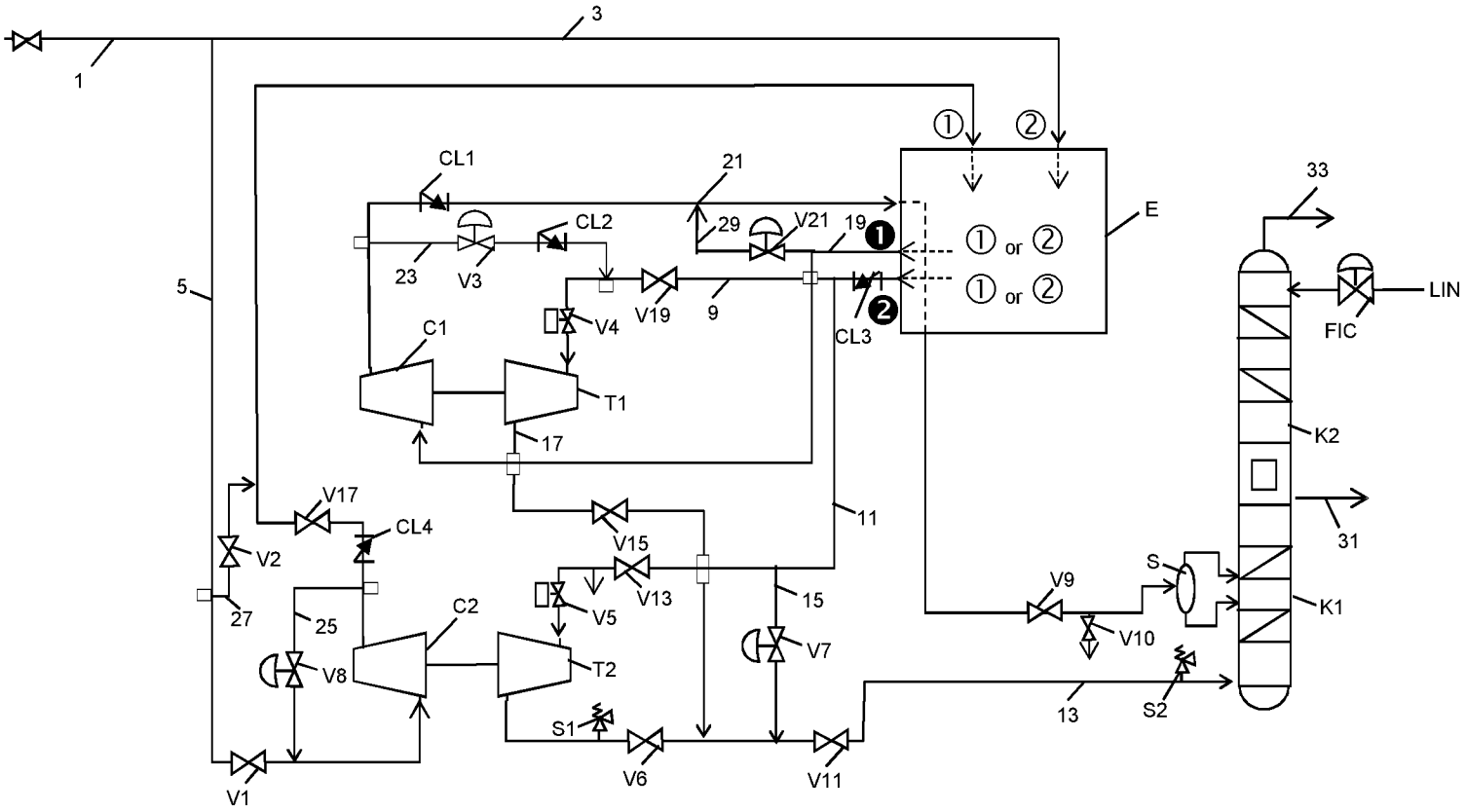
FIG. 1 provides an embodiment of the present invention.

The apparatus comprises a system of columns comprising a column operating at a first pressure K1 and a column operating at a second pressure K2 lower than the first pressure. The columns are thermally connected via a tank reboiler of the second column heated by head nitrogen from the first column. Reflux flows not shown enriched with nitrogen and with oxygen are sent from the column K1 to the column K2.

Liquid oxygen 31 is drawn off in the tank of the second column K2 and nitrogen gas 33 is drawn off at the head of the second column. Liquid nitrogen is sent to the head of the second column in certain phases to assist with cooling the process. Liquid oxygen 31 may evaporate in the heat exchanger E.

The apparatus comprises a second air expansion turbine T2, a first air expansion turbine T1, a warm air compressor C2 coupled to the second air expansion turbine T2 and a cold air compressor C1 coupled to the first air expansion turbine T1. The apparatus may also include a cold box 55, which acts as an insulation enclosure for the first air expansion turbine T1, the second air expansion turbine T2, the system of columns K1, K2 the heat exchanger E, and the cold air compressor C1. Air 1 compressed to a pressure P coming from another compressor (not shown) is divided into two fractions, of which a first fraction 3 is sent to the heat exchanger E without having been compressed to a pressure beyond the pressure P.

A second fraction 5 is sent to the warm compressor C2 where it is compressed to a pressure higher than that (P) of the first fraction 3. The outlet of the warm compressor C2 is connected to the inlet of said warm compressor C2 via a line 25 and through a valve V8.

According to a first variant, the first fraction 3 is cooled in the heat exchanger E to an intermediate temperature of the latter and, not having been compressed in the warm compressor C2, is sent to the cold air expansion turbine T1 and the second air expansion turbine T2 via the open valve CL3 and the open valves V5, V13, V4, V19.

The second fraction 5 is cooled in the heat exchanger E to an intermediate temperature of the latter after it has been compressed in the warm compressor C2. It is then sent to the cold compressor C1.

In normal operation, the expanded air to be separated coming from the cold air expansion turbine T1 and the second air expansion turbine T2 is sent to the first column K1 via the valves V6, V15, V11 and the line 13. The second fraction 5 is compressed in the second cold compressor C1, passes through the open valve CL1 and is then cooled in the heat exchanger before being sent in liquid form to the first column K1 via the valve V9. The valves V2 and V3 are closed.

In the starting phase, there is a risk that air coming from the cold compressor C1 may arrive too hot at the inlet of the exchanger E at the outlet from the cold compressor C1, for example at a temperature higher than the mechanical strength temperature 65° C. of the exchanger.

To prevent this, the valve V9 is closed and the valve V3 open. Accordingly, air coming from the cold compressor C1 no longer passes to the heat exchanger E but to the inlet of the first air expansion turbine T1 via the line 23 and the open valve V3. Not all the air can pass into the first air expansion turbine T1 and the valve V4 is therefore open, the flow rate passing through the turbine being limited by the opening of the blade rings of the turbine and the rest of the air coming from the warm compressor C2 passes to the column via the lines 11 and 15.

It is equally possible to send the starting air to the inlet of the two air expansion turbines T1, T2. Accordingly, the air flows in the line 11 and goes to the second air expansion turbine T2 via the valves V13, V5 and/or the bypass line 15 in which it is expanded by the valve V7 to obtain a pressure reduction similar to that of the second air expansion turbine T2. The valve V2 remains closed.

Figure 2:
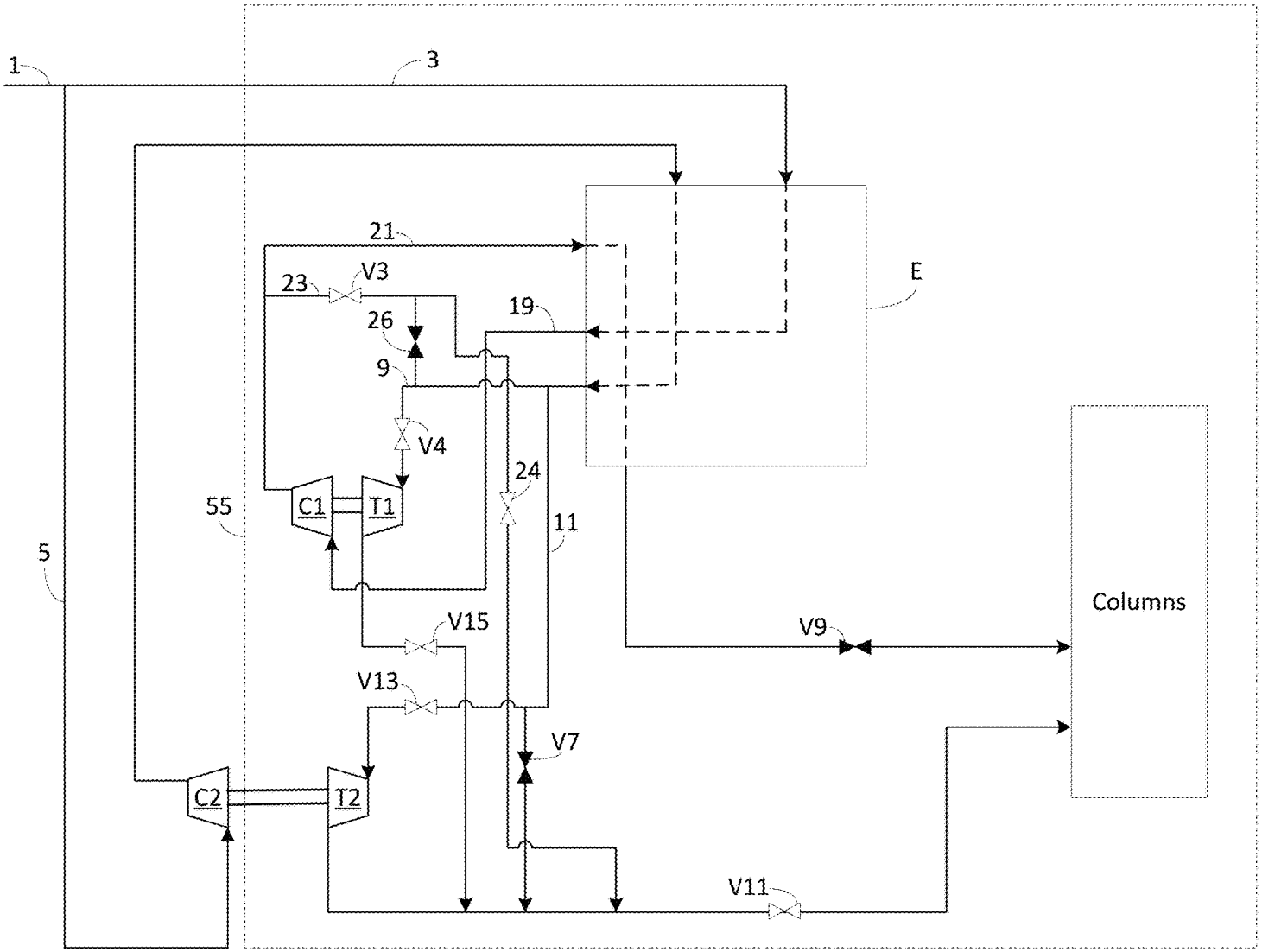
FIG. 2 provides a simplified process flow diagram of certain embodiments of the invention during start-up phase.

It is equally possible to send air coming from the cold compressor C1 to the outlet of the first air expansion turbine T1 and/or to the outlet of the second air expansion turbine T2. Accordingly, air flows neither in the heat exchanger nor in the turbines and passes directly to the distillation column. This embodiment can be seen in FIG. 2. FIG. 2 is similar to FIG. 1, except that it has been greatly simplified in order to more clearly show this embodiment of the invention. Namely that valves 26, V9 and V7 are closed while valve V3 is opened. This allows the air to flow via line 23, be expanded in expansion valve 24 and then combined with the outlets of the first turbine T1 and the second turbine T2, before being introduced into the system of columns.

When the turbines T1, T2 and therefore the compressors C1, C2 are started, the anti-pumping valves of the compressors C1 C2 are totally open (valve V8 for C2 and valve V3 for C1).

This enables hot starting of the cold compressor C1 regardless of the temperature and without consequences for the calculation temperatures of the equipment downstream of the cold compressor C1.

The temperature rise is extremely low on starting, given the minimum compression ratio at the cold compressor C1 thanks to the bounce control valve V3.

According to a second variant, the first fraction 3 has left a heat exchanger at an intermediate temperature of the latter and, not having been compressed in the first warm compressor C2, is sent to the cold compressor C1.

The second fraction 5 is cooled in the heat exchanger to an intermediate temperature of the latter after being compressed in the warm compressor C2. It is then sent to the first and second turbines.

In this case, it is the first fraction 3 of the air that is diverted, on starting, so as no longer to pass through the heat exchanger E but directly to the inlet of the turbine T1 or T2, or even both of them.

As described above, it is recommended to send some of the air coming from the line 23 into the line 9 by opening the valve V19 and then to the line 11 and the bypass line 15 with its valve V7.

A differential approach is possible for the two turbines T1, T2. In order to stop the turbine T2 connected to the hot compressor C2, it is possible to isolate the compressor by closing the valve V1 and opening the valve V2, so that air can transit from the line 5 via the line 27.

In this case, the valves V6 and V13 are closed to isolate the turbine T2 and the necessary frigories are added by adding liquid nitrogen LIN at the head of the low-pressure column K2.

It is equally possible to function with the compressor C1 and the turbine T1 stopped and the compressor C2 and the turbine T2 operating. This degraded approach gives a product at lower pressure and flowrate.

The 1 and 2 circles in the FIGURE are meant to indicate that either of the two air streams 3,5 arriving at the heat exchanger can be connected to either of the two outputs. Therefore, in certain embodiments, either of the two air streams can go straight to the column or via the turbines on which connection is made in the heat exchanger. Additionally, cold compressor C1 can receive air stream 3 or 5 via stream 19 when V21 is closed.

CL2 is a check valve allowing flow in one direction only on the bypass between the cold compressor C1 and the turbine inlet for T1. V10 is a release valve for letting air go to the atmosphere. CIA is another check valve. 17 is the outlet stream from turbine T1 which goes to the column. V17 is a valve on the outlet of the warm compressor.

In another embodiment, the method can include measuring the temperature of the outlet of the cold compressor and upon a determination that the temperature of the outlet stream of cold compressor is above a predetermined temperature, the bypass circuit is used as described above (e.g., open V3 and close V9). In another embodiment, upon a determination that the temperature of the outlet stream is below the predetermined temperature, the bypass circuit is closed off and normal operation commences.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method of starting an air separation apparatus using cryogenic distillation, the air separation apparatus comprising a system of columns, a warm compressor, a second turbine coupled to the warm compressor, a cold compressor and a first turbine, the first turbine being coupled to the cold compressor, wherein the method includes the steps of:

a. wherein in normal operation the method includes the steps of:
   - sending air to a heat exchanger, where the air is partially cooled and subsequently withdrawn at an intermediate temperature of the heat exchanger;
   - compressing the withdrawn air in the cold compressor and then returning the air to the heat exchanger;
   - compressing a second portion of the air in the warm compressor, cooling the second portion of the air in the heat exchanger;
   - sending the second portion of the air from the heat exchanger to the first turbine and/or the second turbine; and
   - sending the second portion of the air from the first turbine and/or second turbine to the system of columns, b. wherein during a start-up operation, the method includes the step of: sending the air from the cold compressor to the system of columns after expansion in an expansion valve via a bypass line provided with the expansion valve, wherein the air is sent from the cold compressor to the system of columns without passing through the heat exchanger, wherein the air is sent from the cold compressor to the system of columns without passing through the first turbine, wherein the air is sent from the cold compressor to the system of columns without passing through the second turbine.

2. The method according to claim 1, wherein the first turbine and the second turbine are started simultaneously.

3. The method according to claim 1, wherein a first valve is used to control a flow of a liquid air stream into the column system, wherein the first valve is closed during the start-up operation.

4. The method according to claim 1, wherein the expansion valve is closed during the normal operation such that no fluid flows across the expansion valve during the normal operation.

5. The method according to claim 1, further comprising the step of measuring a temperature of an outlet stream of the cold compressor and upon a determination that the temperature of the outlet stream of the cold compressor is above a predetermined temperature, the method switches to the start-up operation.

6. The method according to claim 1, further comprising the step of measuring a temperature of an outlet stream of the cold compressor and upon a determination that the temperature of the outlet stream of the cold compressor is below a predetermined temperature, the method switches to the normal operation.

7. The method according to claim 1, wherein the air separation apparatus further comprises a cold box, wherein the system of columns, the cold compressor, the first turbine, the second turbine, and the heat exchanger are disposed within the cold box.

* * * * *